US006726138B2

(12) United States Patent
Grimmel et al.

(10) Patent No.: US 6,726,138 B2
(45) Date of Patent: Apr. 27, 2004

(54) DEVICE FOR CONTROLLING A DISCHARGE DROP POSITION OF ROD WIRE COILS STACKABLE IN A BUNDLE BUILD-UP CHUTE

(75) Inventors: Rüdiger Grimmel, Netphen (DE); Karl Keller, Hilchenbach (DE)

(73) Assignee: SMS Demag Aktiengesellschaft, Düsseldorf (DE)

( * ) Notice: Subject to any disclaimer, the term of this patent is extended or adjusted under 35 U.S.C. 154(b) by 66 days.

(21) Appl. No.: 10/057,358

(22) Filed: Oct. 23, 2001

(65) Prior Publication Data

US 2002/0063138 A1 May 30, 2002

(30) Foreign Application Priority Data

Oct. 25, 2000 (DE) ..... 100 52 731

(51) Int. Cl.[7] ..... B21C 47/02
(52) U.S. Cl. ..... 242/363
(58) Field of Search ..... 242/363, 360, 242/361, 361.1, 361.2, 361.3, 361.4, 361.5, 362, 362.1, 362.2, 362.3

(56) References Cited

U.S. PATENT DOCUMENTS 5,143,315 A * 9/1992 Faessel et al. ..... 242/360
RE35,440 E * 2/1997 Starvaski ..... 242/363
5,779,174 A * 7/1998 Starvaski et al. ..... 242/363
6,158,683 A * 12/2000 David et al. ..... 242/363
6,402,074 B1 * 6/2002 Shore et al. ..... 242/363
6,405,958 B1 * 6/2002 Behrens et al. ..... 242/361.1

FOREIGN PATENT DOCUMENTS

DE 196 20 578 A1 * 11/1997
EP 0 799 657 A2 * 10/1997

* cited by examiner

*Primary Examiner*—John M. Jillions
(74) *Attorney, Agent, or Firm*—Sidley Austin Brown & Wood, LLP

(57) ABSTRACT

A device for controlling a discharge drop position of rod wire coils transportable by a horizontal conveyor and stackable in a vertical bundle build-up chute located beneath an end of the transporting conveyor and behind the transporting conveyor end in a transporting direction, with the device including friction brake element for impacting an outer circumference of the rod wire coils and located opposite the transporting conveyor end at a distance therefrom and beneath a charging opening of the bundle build-up chute in a drop region of the rod wire coils.

3 Claims, 4 Drawing Sheets

DEVICE FOR CONTROLLING A DISCHARGE DROP POSITION OF ROD WIRE COILS STACKABLE IN A BUNDLE BUILD-UP CHUTE

BACKGROUND OF THE INVENTION

1. Field of the Invention

The present invention relates to a device for controlling a discharge drop position of rod wire coils transportable by a horizontal conveyor and stackable in a vertical bundle build-up chute located beneath an end of the transporting conveyor and behind the transporting conveyor end in a transporting direction.

2. Description of the Prior Art

The prior art discloses numerous devices of the above-described type which are designed to position the rod wire coils, during their drop movement after they leave the conveyor, so that they drop somewhat concentrically with respect to the central axis of the bundle build-up chute for being stacked one upon the other to form a substantially cylindrical bundle. If necessary, sometimes, the rod wire coils are stacked one upon another in an offset prearranged pattern in order to increase the stack density and the vertical stability of a produced bundle.

German Publication DE 196 20 578 A1 discloses a device including a cylindrical member having a funnel-shaped charging opening and which is arranged beneath a discharge end of a rod wire coil transporting conveyor above the charging opening of a bundle build-up chute. The cylindrical member is displaceable in a horizontal plane transverse to the vertical axis of the chute and is also tiltable. The device of DE 196 20 578 A1 permits to establish the above-mentioned prearranged pattern, which increases the stack density of the wire bundle.

European Publication EP 04 42 835 B1 also discloses a device for increasing the stack density. With this device, falling rod wire coils are collected to form a stack about a magnet, with the falling of the rod wire coils being controlled by a magnetic field. The rod wire coils are brought into their predetermined stack position by controlling the circumferential magnetic field.

European Publication EP 07 99 657 A2 discloses a device which includes a deflection element in form of a funnel section that is provided on an edge of the charging opening of a bundle build-up chute. The deflection element deflects the falling rod wire coils toward the central axis of the bundle build-up chute, forming a wire bundle with substantially cylindrical dimensions.

The operation of the above-discussed devices is impaired by the fact that upon leaving the transporting conveyor, separate rod wire coils tilt with respect to a horizontal plane under an ever increasing excess weight of the coil section overhanging the conveyor end. As a result of tilting, the rod wire coils occupy an inclined drop position. The inclined drop position of the rod wire coils adversely affects the operational process of the above-mentioned devices and their setting accuracy.

Accordingly, an object of the present invention is to provide a device that would counteract the tendency of the wire rod coils to occupy a tilting drop position upon leaving the transporting conveyor and that would bring the tillable rod wire coils in a substantially horizontal position that would be retained during the further drop movement.

SUMMARY OF THE INVENTION

This and other objects of the present invention, which will become apparent hereinafter, are achieved by providing a device having a friction brake element for impacting an outer circumference of the rod wire coils and located opposite the transporting conveyor end at a distance therefrom and beneath the charging opening of the bundle build-up chute in a drop region of the rod wire coils, and a support for supporting the friction brake element. According to an advantageous embodiment of the present invention, the friction brake element is formed as a brush element pivotable in opposite directions toward the transporting conveyor end and away therefrom. The brush element can be formed as a rotary brush or as a rotatable brush band.

The novel features of the present invention, which are considered as characteristic for the invention, are set forth in the appended claims. The invention itself, however, both as to is construction and its mode of operation, together with additional advantages and objects thereof, will be best understood from the following detailed description of preferred embodiments, when read with reference to the accompanying drawings.

DETAILED DESCRIPTION OF THE PREFERRED EMBODIMENTS

Figure 1:
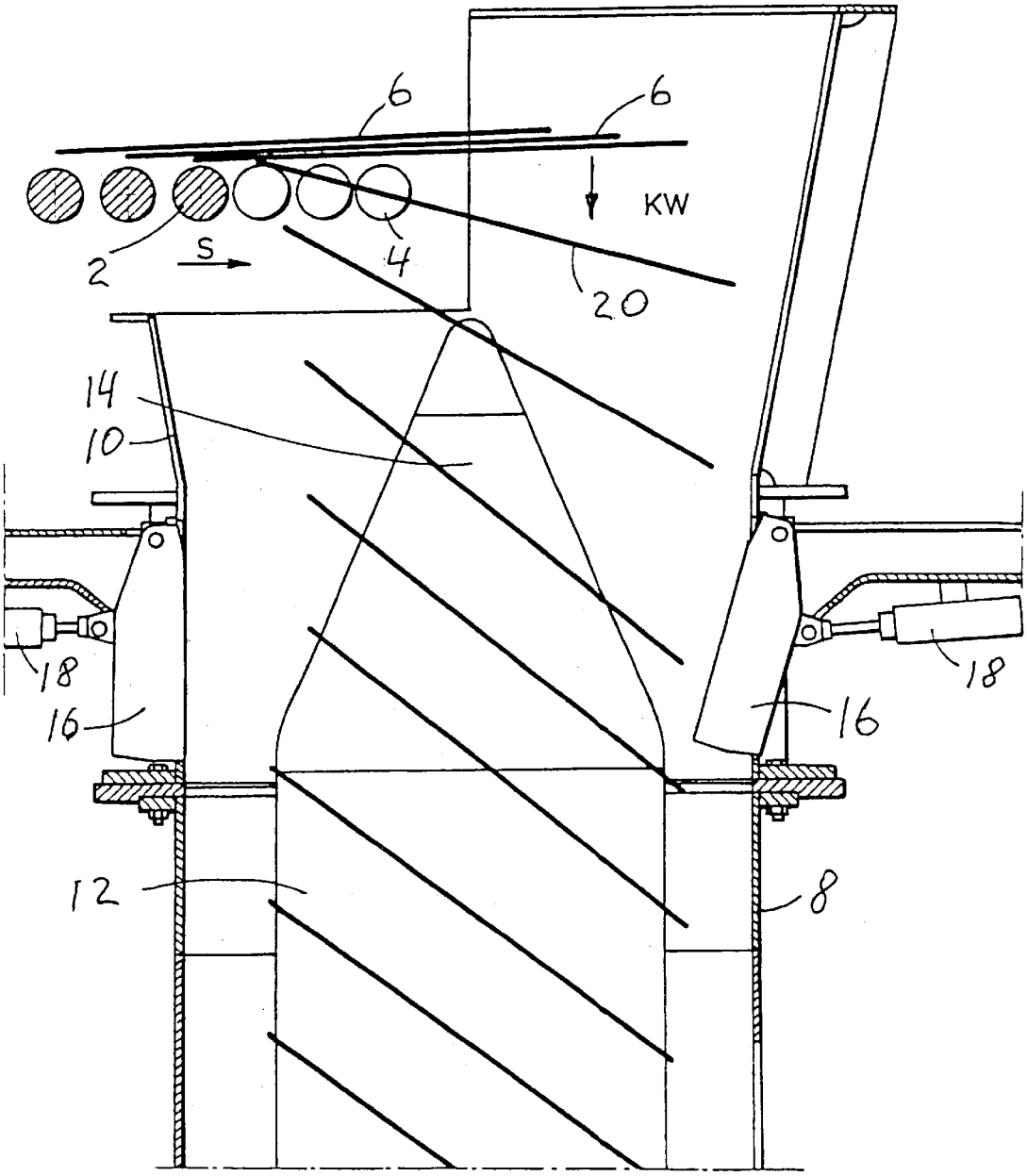
FIG.1 PRIOR ART
FIG. 1 a vertical cross-sectional view of a prior art device for controlling a discharge drop position of rod wire coils stackable in a bundle build-up chute.

As shown in the drawings, after being rolled, rod wire coils 6 are transported by a conveyor 2 in the direction of arrow S to a bundle build-up chute 8 located beneath a discharge end 4 of the conveyor 2. The bundle build-up chute 8 has a funnel-shaped headpiece 10. In the center of the build-up chute 8, there is provided a vertically extending, bundle build-up mandrel 12 having a mandrel tip 14. In the region of the mandrel tip 14, the funnel-shaped headpiece 10 is provided with pivotal guide members 16 that are engaged from outside by respective servomechanisms 18.

As shown in the drawings, first conveyed rod wire coils 20, upon reaching the end 4 of the conveyor 2, tilt under their own weight over the conveyor end 4 in the direction of arrow KW downwardly and fall into a charging opening of the funnel-shaped headpiece 10.

The guide members 16 which, as shown on the right side of the drawings, are inclined inward, impact the outer edges of the fallen rod wire coils 6 and direct the rod wire coils 6 toward a vertical central axis of the chute 8 or the headpiece 10. In this way, the guide members 16 cannot influence the tilt position of the rod wire coils 6 or can influence their tilt position only to a small degree.

Figure 2:
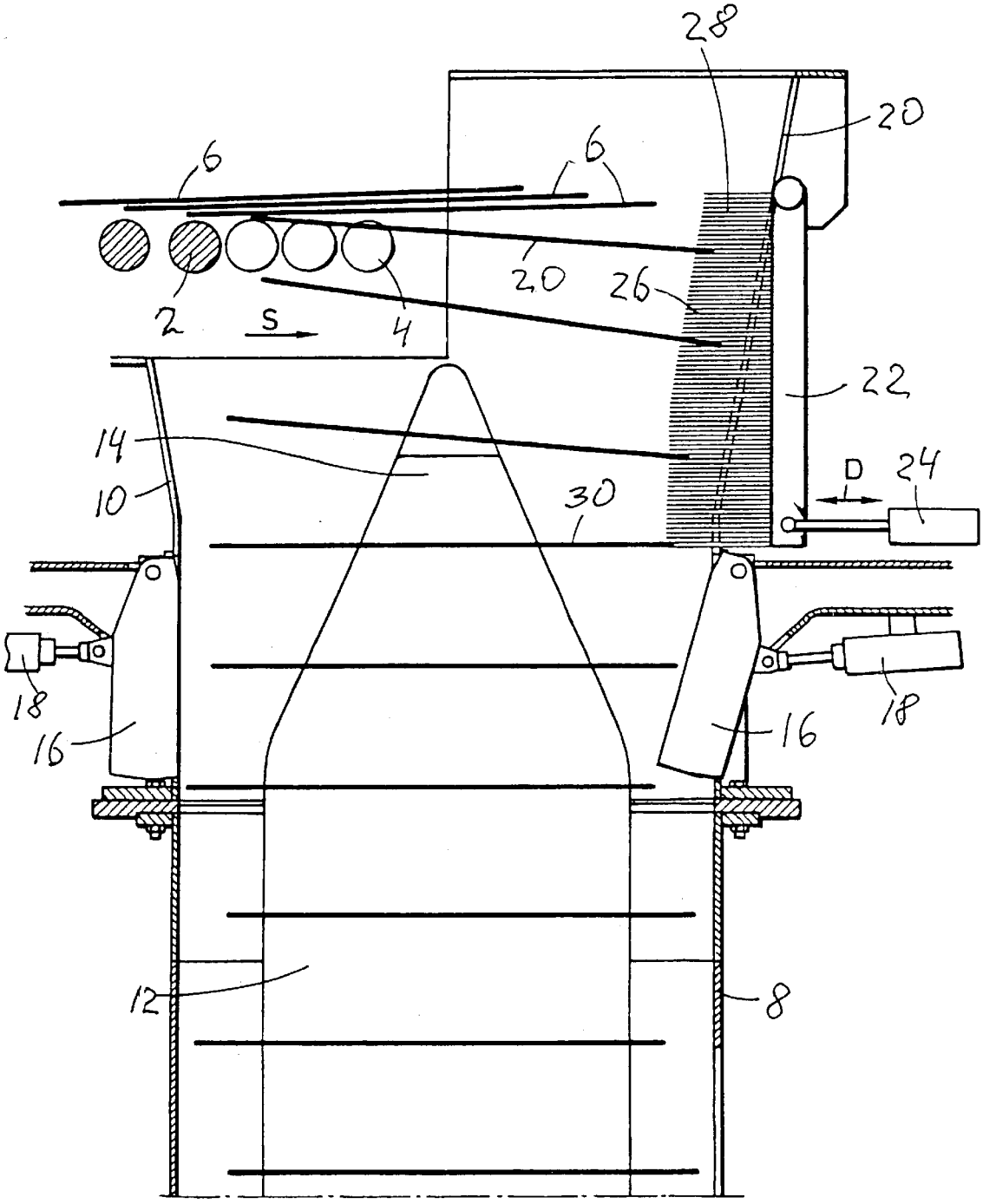
FIG. 2 a vertical cross-sectional view of a first embodiment of a device according to the present invention for controlling a discharge drop position of rod wire coils stackable in a bundle build-up chute.

According to the present invention, as shown in FIG. 2, there is provided, opposite the end 4 of the rod wire coil-delivering conveyor 2, a support 22 that adjoins a section 20 which forms an elongation of a wall of the headpiece 10. At its lower end, the support 22 is connected with a horizontally displaceable, in direction of a double arrow D, servo element 24.

On the side of the support 22 facing the end 4 of the conveyor 2, there is provided a brush element 26. Free ends of the bristles 28 of the brush element 26 impacts the outer edge of the fallen rod wire coils 6 and exert a braking effect on a tilting movement of the first rod wire coils 20 and following them remaining rod wire coils 6. As a result, during the subsequent downward movement, the rod wire coils 20(6) attain a horizontal position, as shown by a reference numeral 30. The braking force applied by the bristles 28 can be controlled with the servo element 24.

Figure 3:
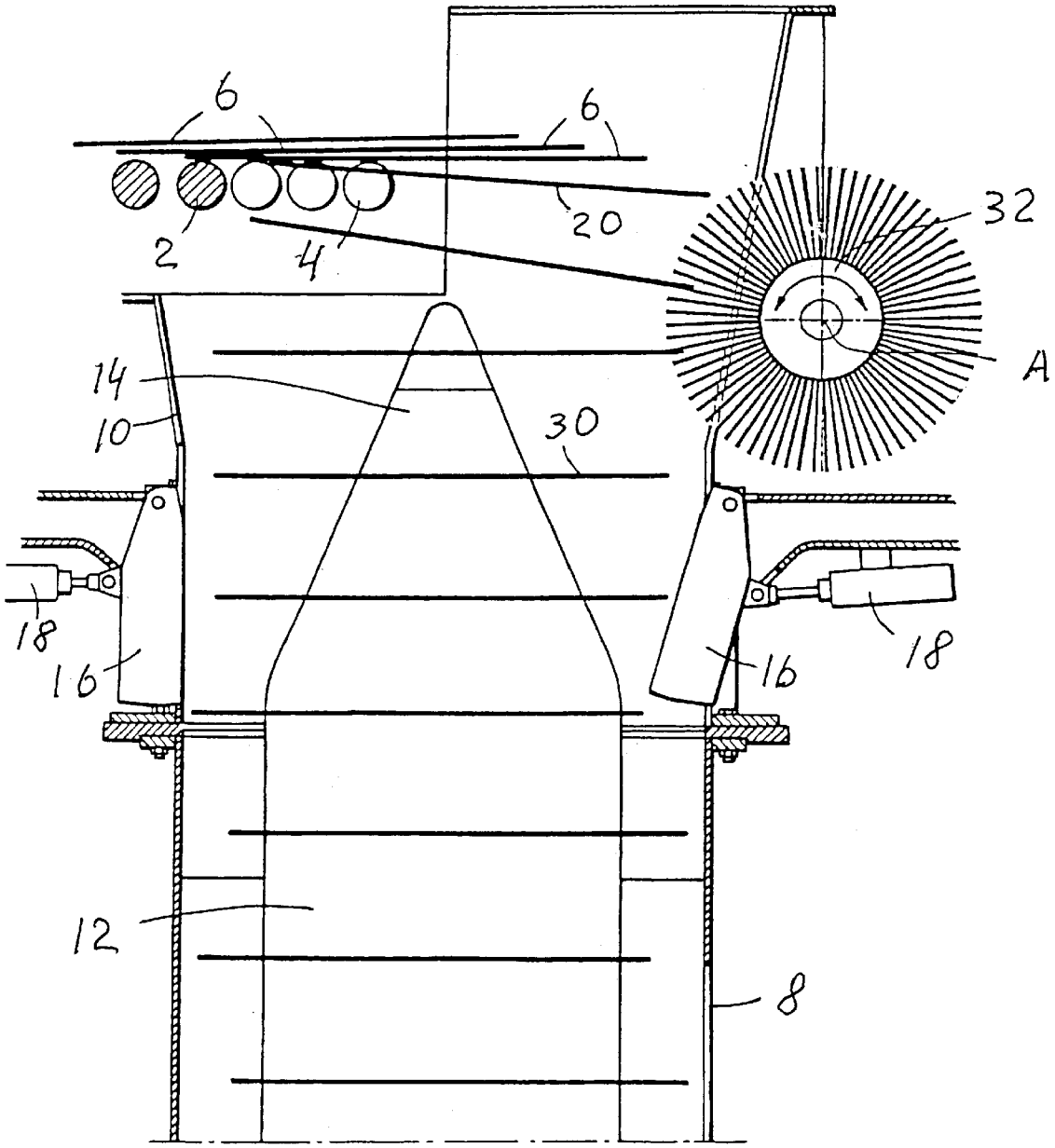
FIG. 3 a vertical cross-sectional view of a second embodiment of a device according to the present invention for controlling a discharge drop position of rod wire coils stackable in a bundle build-up chute.

The embodiment of the inventive device, which is shown in FIG. 3, differs from that of FIG. 2 in that instead of a straight brush element 26, there is provided a rotatable in opposite direction directions about an axis A, cylindrical rotary brush 32 displaceable in vertical and horizontal directions by appropriate servo means (not shown).

Figure 4:
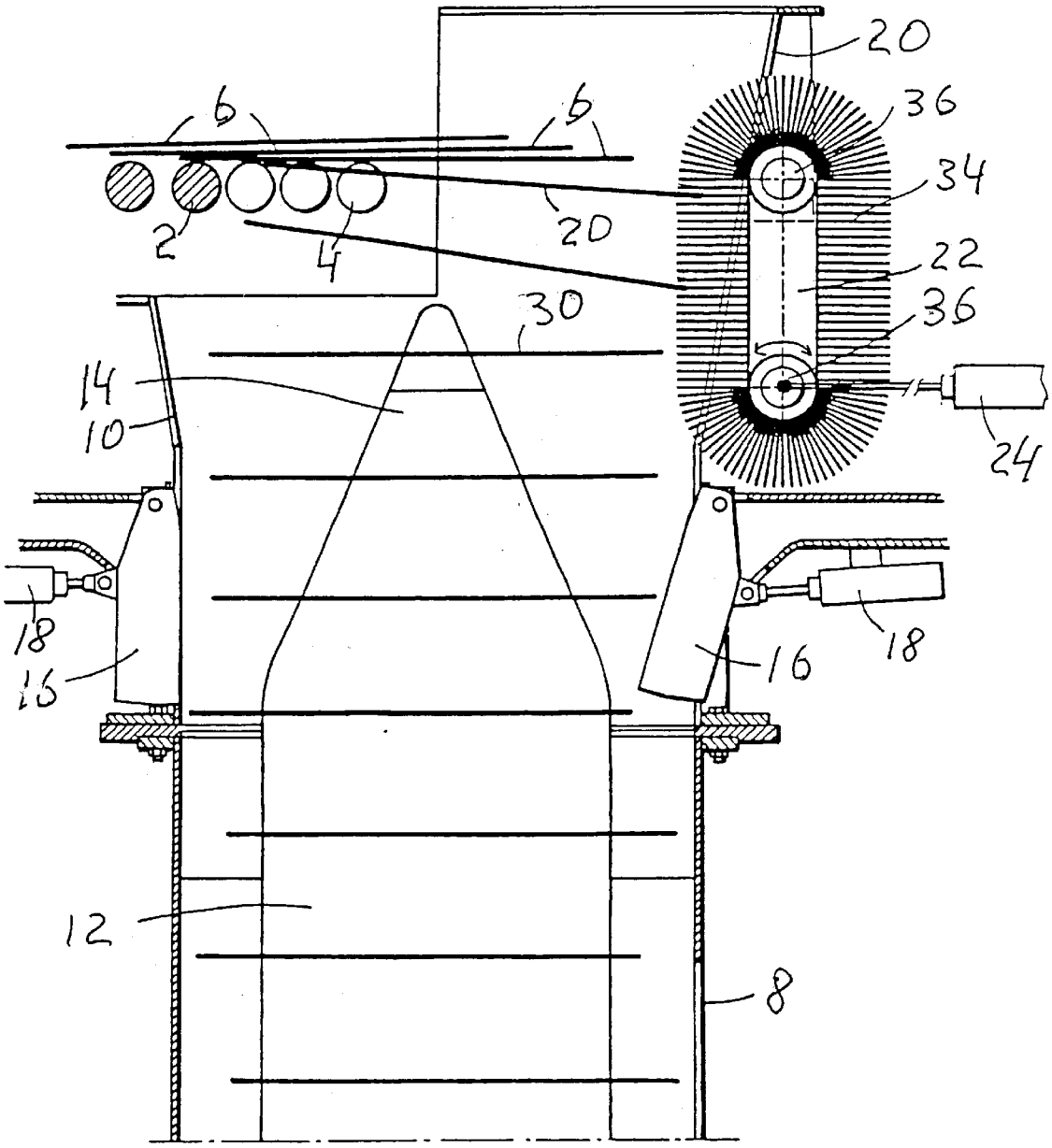
FIG. 4 a vertical cross-sectional view of a third embodiment of a device according to the present invention for controlling a discharge drop position of rod wire coils stackable in a bundle build-up chute

In the embodiment of the inventive device shown in FIG. 4, there is provided, instead of a rotary brush, a displaceable in opposite directions brush band 34 having opposite axles 36 supported in a support 22 which is pivoted by the servo element 24 displaceable horizontally in a manner shown in FIG. 2.

Though the present invention was shown and described with references to the preferred embodiments, such are merely illustrative of the present invention and are not to be construed as a limitation thereof, and various modifications to the present invention will be apparent to those skilled in the art. It is, therefore, not intended that the present invention be limited to the disclosed embodiments or details thereof, and the present invention includes all of variations and/or alternative embodiments within the spirit and scope of the present invention as defined by the appended claims.

What is claims is:

1. A device for controlling a discharge drop position of rod wire coils transportable by a horizontal conveyor and stackable in a vertical bundle build-up chute located beneath an end of the transporting conveyor and behind the transporting conveyor end in a transporting direction, the device comprising:

friction brake means for impacting an outer circumference of the rod wire coils and located opposite the transporting conveyor end at a distance therefrom and beneath a charging opening of the bundle build-up chute in a drop region of the rod wire coils; and support means for supporting the friction brake means, wherein the friction brake means comprises a brush element, and the device further comprises means for pivoting the brush element in opposite directions toward the transporting conveyor and away therefrom.

2. A device as set forth in claim 1, wherein the brush element comprises a rotary brush.

3. A device as set forth in claim 1, wherein the brush element comprises a rotatable brush band.

* * * * *